US007710414B2

(12) United States Patent
Lee et al.

(10) Patent No.: US 7,710,414 B2
(45) Date of Patent: May 4, 2010

(54) COMMON VOLTAGE REGULATING CIRCUIT OF LIQUID CRYSTAL DISPLAY DEVICE

(75) Inventors: Hwa Jeong Lee, Kyoungki-do (KR); Jin Tak Kim, Kyoungki-do (KR); Hang Seok Oh, Daejeon (KR)

(73) Assignee: Hydis Technologies Co., Ltd., Gyeonggi-do (KR)

( * ) Notice: Subject to any disclaimer, the term of this patent is extended or adjusted under 35 U.S.C. 154(b) by 808 days.

(21) Appl. No.: 11/545,855

(22) Filed: Oct. 3, 2006

(65) Prior Publication Data

US 2007/0030231 A1 Feb. 8, 2007

Related U.S. Application Data

(62) Division of application No. 10/619,351, filed on Jul. 14, 2003, now Pat. No. 7,138,996.

(30) Foreign Application Priority Data

Nov. 4, 2002 (KR) ..... 2002-67815

(51) Int. Cl.
*G09G 5/00* (2006.01)

(52) U.S. Cl. ..... 345/212

(58) Field of Classification Search ..... 345/52, 345/87, 89, 90, 94, 95, 101, 204, 211–214, 345/690, 691; 315/169.1; 349/33, 34
See application file for complete search history.

(56) References Cited

U.S. PATENT DOCUMENTS 5,534,889 A 7/1996 Reents et al.
5,561,442 A 10/1996 Okada et al.
5,940,055 A 8/1999 Lee (Continued)

FOREIGN PATENT DOCUMENTS

JP 64-078084 A 3/1989

(Continued)

OTHER PUBLICATIONS

Application Note 818; "Digital Adjustment of DC-DC Converter Output Voltage in Portable Applications" MAXIM, Oct. 2, 2001.

*Primary Examiner*—Richard Hjerpe
*Assistant Examiner*—Tom V Sheng
(74) *Attorney, Agent, or Firm*—Ladas & Parry LLP

(57) ABSTRACT

Disclosed is a common voltage regulating circuit of a liquid crystal display device which can be adjusted by software, comprising: a pulse signal generating means for outputting a pulse width modulation signal in response to up/down signal for adjusting a common voltage; a smoothing means for smoothing a pulse width modulation signal to a direct current level provided from the pulse signal generating means; and an amplifying means for amplifying the signal smoothed by the smoothing means to a predetermined level and then outputting a common voltage signal. Accordingly, since a common voltage can be adjusted by software by means of a surplus pulse width modulation signal generated in an integrated board without installing a separate hardware, the common voltage can be easily adjusted. Further, since a variable resistor has not been used, not only manufacturing cost but also possibility of breakage can be reduced.

19 Claims, 14 Drawing Sheets

U.S. PATENT DOCUMENTS

| | | | | |
|---|---|---|---|---|
| 6,166,714 | A * | 12/2000 | Kishimoto | 345/96 |
| 6,201,523 | B1 * | 3/2001 | Akiyama et al. | 345/96 |
| 6,236,384 | B1 | 5/2001 | Didier et al. | |
| 6,346,903 | B1 | 2/2002 | Messager | |
| 6,388,967 | B2 | 5/2002 | Furukawa et al. | |
| 6,677,925 | B1 * | 1/2004 | Kawaguchi et al. | 345/98 |
| 6,784,863 | B2 * | 8/2004 | Yanagi et al. | 345/96 |
| 7,015,903 | B2 * | 3/2006 | Lee | 345/212 |
| 7,050,027 | B1 * | 5/2006 | Macrae | 345/87 |
| 7,102,604 | B2 * | 9/2006 | Hong | 345/87 |
| 7,239,310 | B2 * | 7/2007 | Iinuma | 345/211 |
| 2002/0097206 | A1 | 7/2002 | Willis | |

FOREIGN PATENT DOCUMENTS

| | | | |
|---|---|---|---|
| JP | 06-237162 | A | 8/1994 |
| JP | 08-082785 | A | 3/1996 |

* cited by examiner

| COMMON VOLTAGE ADJUSTMENT MENU VALUE | PWM DUTY (%) | SMOOTHED DC VALUE (V) | VCOM VALUE (V) |
|---|---|---|---|
| 00 | 45.18 | 1.508 | 3.676 |
| 01 | 45.55 | 1.518 | 3.704 |
| 02 | 46.3 | 1.548 | 3.766 |
| 03 | 46.72 | 1.556 | 3.794 |
| 04 | 47.07 | 1.571 | 3.831 |
| 05 | 47.13 | 1.566 | 3.834 |
| 06 | 47.51 | 1.58 | 3.861 |
| 07 | 47.94 | 1.59 | 3.895 |

COMMON VOLTAGE REGULATING CIRCUIT OF LIQUID CRYSTAL DISPLAY DEVICE

BACKGROUND OF THE INVENTION

1. Field of the Invention

The present invention relates to a common voltage regulating circuit of a liquid crystal display device, and more particularly to a common voltage regulating circuit of a liquid crystal display device capable of adjusting a common voltage by software.

2. Description of the Prior Art

Generally, a TFT-LCD is a device for displaying an image by adjusting light transmissivity after changing an orientation of a liquid crystal through charge/discharge of capacitors formed between pixel electrodes and common electrodes. A signal voltage is applied to the pixel electrode through a data line and TFT performing a switching, and a common voltage is applied to the common electrode. Herein, in order to minimize flicker, the common voltage is finely adjusted by means of a common voltage regulating circuit to a predetermined value.

FIG. 1 is a schematic diagram showing a common voltage regulating circuit of a liquid crystal display device according to a prior art. As shown in FIG. 1, the common voltage regulating circuit includes a voltage distribution section 10 and a buffer amplifier 20. The voltage distribution section 10 includes three resistors, that is, a first resistor R1, a second resistor R2 and a variable resistor VR1, which are coupled in series between a power supply terminal and a ground, and distributes supply voltage. The buffer amplifier 20 includes a capacitor C1 coupled between an output terminal and a ground, receives a distribution voltage, which is a reference voltage, adjusted by the variable resistor VR1 through a non-inverting input terminal (+), and feedbacks an output signal VCOM to a inverting input terminal (−). Further, the buffer amplifier 20 outputs a common voltage signal VCOM after buffering the adjusted distribution voltage.

FIG. 2 is a front view of a liquid crystal display panel employing the circuit of FIG. 1. A reference numeral 100 represents a width of a bezel of front surface of the liquid crystal display panel and a reference numeral 102 represents a groove for adjustment of the resistance of the variable resistor.

FIG. 3 is a rear view of a liquid crystal display panel employing the circuit of FIG. 1. As shown in FIG. 3, the liquid crystal display panel includes a source-drive IC 104 for driving a data line of the liquid crystal display panel, a gate-drive IC 106 for driving a gate line of the liquid crystal display panel, a source-printed circuit board 108 for supplying a power source and a driving signal to the source-drive IC 104, a gate-printed circuit board 110 for supplying a power source and a driving signal to the gate-drive IC 106, a first cable 112 for connecting the source-printed circuit board 108 with the gate-printed circuit board 110, and an integrated board 114 with which a liquid crystal driving circuit, which drives the liquid crystal display panel, and an interface circuit, which converts an input image signal such as a LVDS, a TTL, or a TMDS into a digital type and adjusts the resolution, have been formed integrally. Further, the liquid crystal display panel includes a second cable 116 for connecting the source-printed circuit board 108 with the integrated board 114, an inverter 118 for driving a backlight of a liquid crystal display, a connector 120 for sending the image signal to the integrated board 114, a third cable 122 for connecting the integrated board 114 with the inverter 118 and a variable resistor 124 utilized for a fine adjustment of the common voltage.

FIG. 4 is a rear view of another embodiment of a liquid crystal display panel employing the circuit of FIG. 1 and is a schematic view showing rear surface of the liquid crystal display panel in which the interface circuit and the inverter are omitted. In the following description and drawings, the same reference numerals are used to designate the same elements as those shown in FIG. 3.

As shown in FIG. 2 and FIG. 3, the conventional common voltage regulating circuit is installed on the gate-printed circuit board 110. The integrated board 114 includes a block of generating the supply voltage AVDD and supplies the supply voltage AVDD to the source-printed circuit board 108 and the gate-printed circuit board 110 through the second cable 116. Herein, the supply voltage AVDD is sufficiently larger than the level of the common voltage VCOM outputted from the common voltage regulating circuit.

Referring to FIG. 2 and FIG. 3, the operation of the common voltage regulating circuit is briefly described. First, when the supply voltage AVDD generated in the integrated board 114 is supplied to the common voltage regulating circuit, the voltage distribution section 10 distributes the supply voltage AVDD by means of the first resistor R1, the second resistor R2 and the variable resistor VR1 on the basis of a value set by the variable resistor VR1, and then outputs the distributed voltage, which is a reference voltage, to the buffer amplifier 20. Then, the buffer amplifier 20 amplifies the reference voltage by a unity gain and then outputs a stable common voltage signal VCOM.

In the conventional common voltage regulating circuit, parts, such as a cheap transistor, have been used as means for outputting the stable common voltage signal, or the output of the variable resistor has been directly used as the common voltage signal.

When the liquid crystal display device is manufactured by means of the conventional common voltage regulating circuit as described above, as shown in FIG. 2 and FIG. 3, a groove for adjustment of a resistance of the variable resistor must be formed usually on the front surface of the panel, or sometimes on the rear surface of the panel. Therefore, when the bezel inevitably has a narrow width in designing the liquid crystal display device, there are some restrictions in forming the groove. Further, when a liquid crystal display device has no gate-printed circuit board, the position of the variable resistor must be shifted to the source-printed circuit board, thereby causing some difficulties in the structural design of the liquid crystal display device.

Further, when the liquid crystal display device is manufactured to have the conventional common voltage regulating circuit, there are some difficulties in fine adjustment in accordance with the accuracy of the variable resistor, and the variable resistor may be broken owing to a structural defect. Further, as the variable resistor is used, the manufacturing cost increases.

Further, when a complete display, such as a monitor, has been manufactured by means of a liquid crystal display device having the conventional common voltage regulating circuit after completing the adjustment of the common voltage, it is impossible to readjust the common voltage unless the display device is disassembled.

SUMMARY OF THE INVENTION

Accordingly, the present invention has been made to solve the above-mentioned problems occurring in the prior art, and an object of the present invention is to provide a common voltage regulating circuit of a liquid crystal display device which can easily adjust a common voltage by adjusting the common voltage by software by means of a surplus pulse width modulation signal generated in an integrated board, instead of a variable resistor, without installing separate hardware.

In order to achieve the above objects, according to a first embodiment of the present invention, there is provided a common voltage regulating circuit of a liquid crystal display device, comprising: a pulse signal generating means for outputting a pulse width modulation signal in response to up/down signal for adjusting a common voltage; a smoothing means for smoothing the pulse width modulation signal from the pulse signal generating means to a direct current level; and an amplifying means for amplifying the signal smoothed by the smoothing means to a predetermined level and outputting a common voltage signal.

In order to achieve the above objects, according to a second embodiment of the present invention, there is provided a common voltage regulating circuit of a liquid crystal display device, comprising: a data generating means for outputting a synchronizing signal and a serial digital data signal in response to an up/down signal for adjusting a common voltage; a digital/analog converting means for converting the serial digital data signal into an analog signal in response to the synchronizing signal of the data generating means; and a buffer amplifying means for buffering the analog signal converted by the digital/analog converting means and then outputting a common voltage signal.

In order to achieve the above objects, according to a third embodiment of the present invention, there is provided a common voltage regulating circuit of a liquid crystal display device, comprising: a data generating means for outputting a synchronizing signal and a parallel digital data signal in response to an up/down signal for adjusting a common voltage; a digital/analog converting means for converting the parallel digital data signal into an analog signal in response to the synchronizing signal of the data generating means; and a buffer amplifying means for buffering the analog signal converted by the digital/analog converting means and then outputting a common voltage signal.

In order to achieve the above objects, according to a fourth embodiment of the present invention, there is provided a common voltage regulating circuit of a liquid crystal display device, comprising: a data storage means for receiving a first selection signal, a second selection signal, a synchronizing signal and a serial digital data signal in order to adjust a common voltage, and storing and outputting data according to a combination of the first selection signal and the second selection signal; a digital/analog converting means for receiving the serial digital data signal from the data storage means in response to the synchronizing signal and converting the received signal into an analog signal; and a buffer amplifying means for buffering the analog signal converted by the digital/analog converting means and outputting a common voltage signal.

In order to achieve the above objects, according to a fifth embodiment of the present invention, there is provided a common voltage regulating circuit of a liquid crystal display device, comprising: a data storage means for receiving a first selection signal, a second selection signal, a synchronizing signal and a parallel digital data signal in order to adjust a common voltage, and storing and outputting data according to a combination of the first selection signal and the second selection signal; a digital/analog converting means for receiving the parallel digital data signal from the data storage means in response to the synchronizing signal and converting the received signal into an analog signal; and a buffer amplifying means for buffering the analog signal converted by the digital/analog converting means and outputting a common voltage signal.

In order to achieve the above objects, according to a sixth embodiment of the present invention, there is provided a common voltage regulating circuit of a liquid crystal display device, comprising: a data storage means for receiving a first selection signal, a second selection signal and a pulse width modulation signal, and storing and outputting the pulse width modulation signal according to a combination of the first selection signal and the second selection signal; a smoothing means for receiving the pulse width modulation signal from the data storage means and smoothing the received signal to a direct current level; and an amplifying means for amplifying the signal smoothed by the smoothing means to a predetermined level and outputting a common voltage signal.

The preferred embodiments will now be described below in detail in reference to the accompanying drawings.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a preferred embodiment of the present invention will be described in detail with reference to the accompanying drawings.

Figure 1:
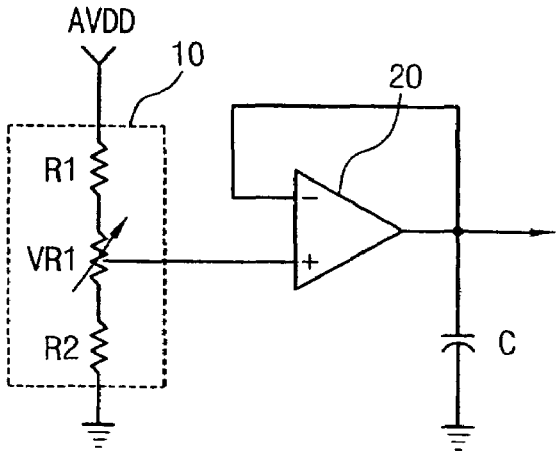
FIG.1 (PRIOR ART)
FIG. 1 is a schematic diagram showing a common voltage regulating circuit of a liquid crystal display device according to a prior art.
Figure 2:
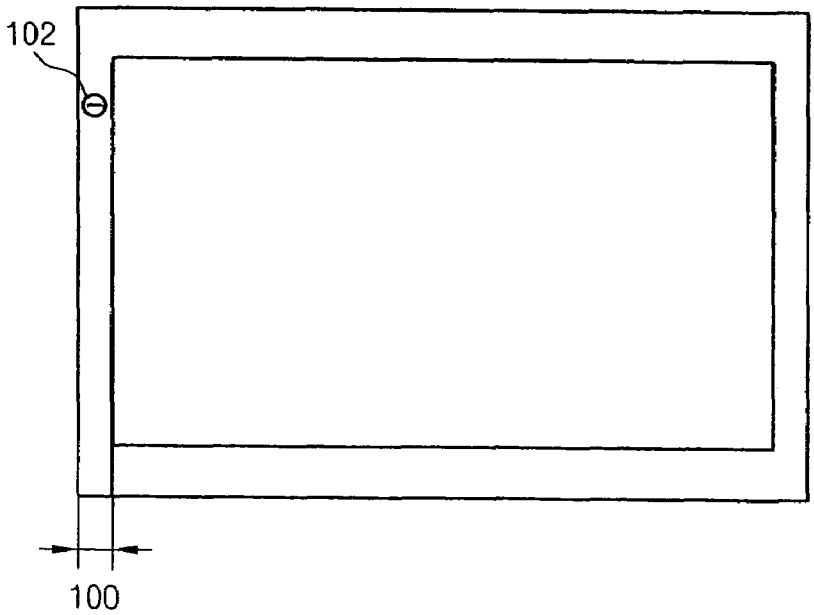
FIG.2 (PRIOR ART)
FIG. 2 is a front view of a liquid crystal display panel employing the circuit of FIG. 1.
Figure 5:
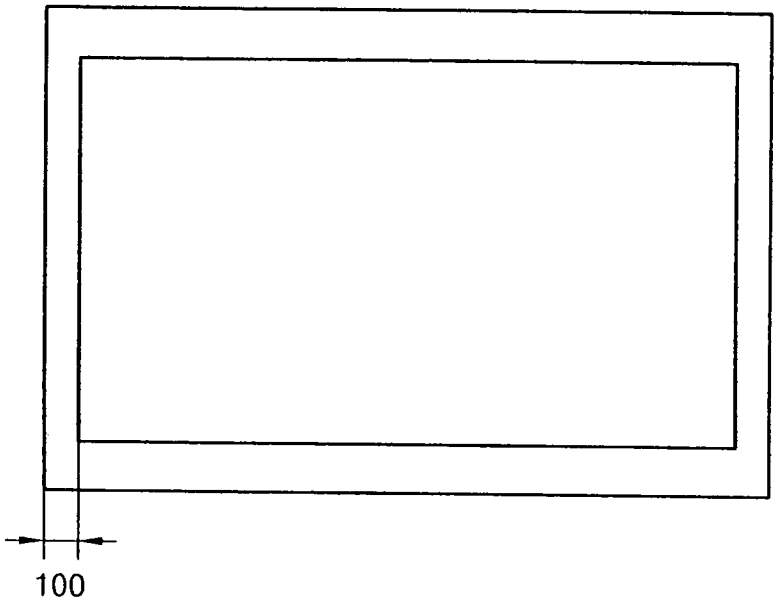
FIG. 5 is a front view of a liquid crystal display panel employing a common voltage regulating circuit of the present invention.

FIG. 5 is a front view of a liquid crystal display panel employing a common voltage regulating circuit of the present invention. Herein, the same reference numerals are used for the same components shown in FIG. 2.

Figure 3:
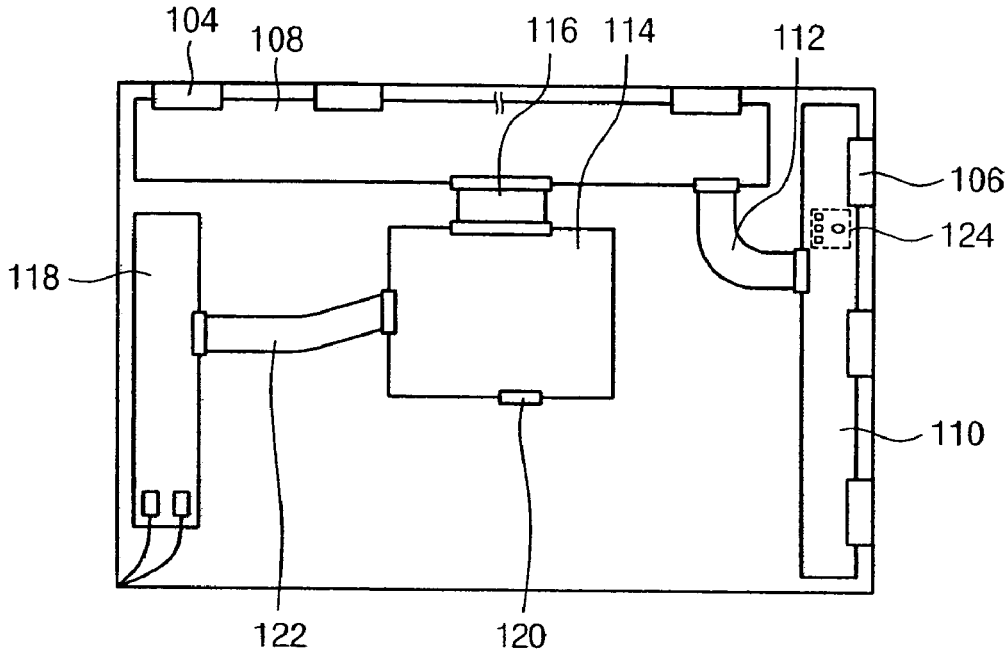
FIG.3 (PRIOR ART)
FIG. 3 is a rear view of a liquid crystal display panel employing the circuit of FIG. 1.
Figure 6:
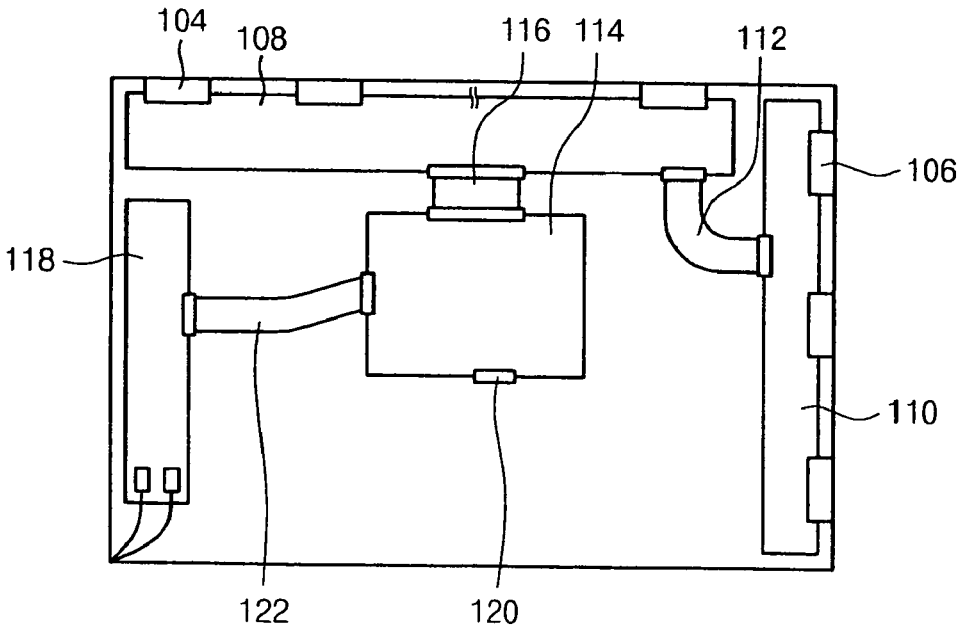
FIG. 6 is a rear view of the liquid crystal display panel employing the common voltage regulating circuit of the present invention.

FIG. 6 is a rear view of the liquid crystal display panel employing the common voltage regulating circuit of the present invention. Herein, the same reference numerals are used for the same components shown in FIG. 3.

Figure 4:
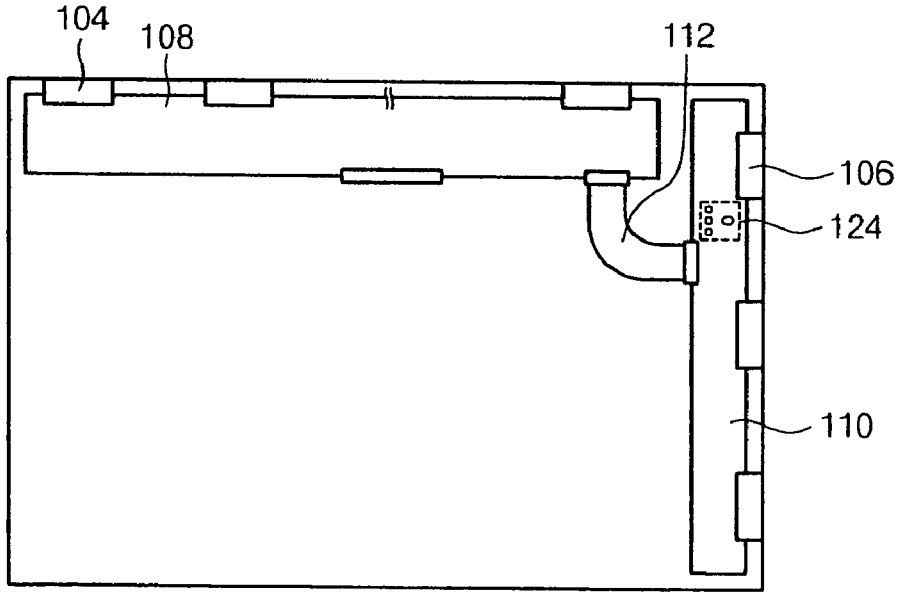
FIG.4 (PRIOR ART)
FIG. 4 is a rear view of a liquid crystal display panel of another embodiment employing the circuit of FIG. 1.
Figure 7:
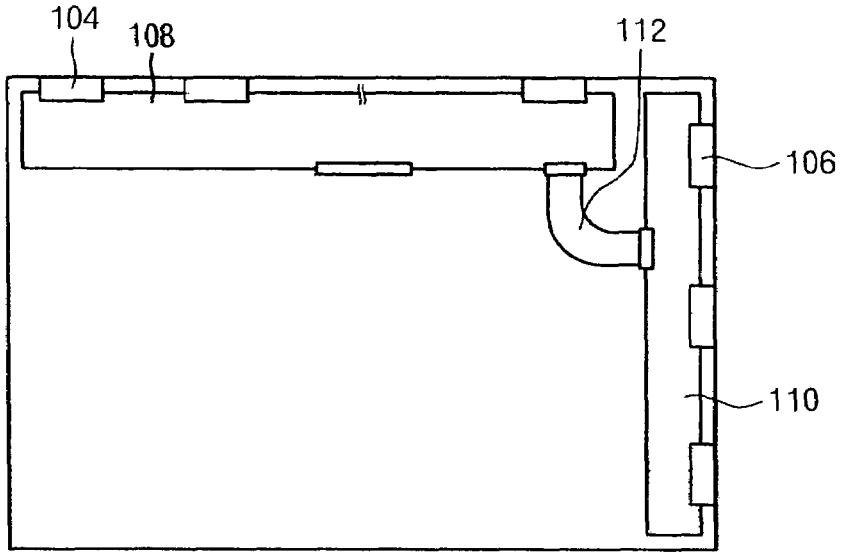
FIG. 7 is a rear view of the liquid crystal display panel of another embodiment employing the common voltage regulating circuit of the present invention.

FIG. 7 is a rear view of another embodiment of the liquid crystal display panel employing the common voltage regulating circuit of the present invention. Herein, the same reference numerals are used for the same components shown in FIG. 4.

The difference between the liquid crystal display panel employing an embodiment of the present invention and the prior art is that the groove 102, which has been formed in a bezel of a front surface of the liquid crystal display panel in order to adjust the resistance of the variable resistor, and the variable resistor 124, which has been installed on the gate-printed circuit board 110, have been removed as shown in FIG. 6 and FIG. 7.

Figure 8:
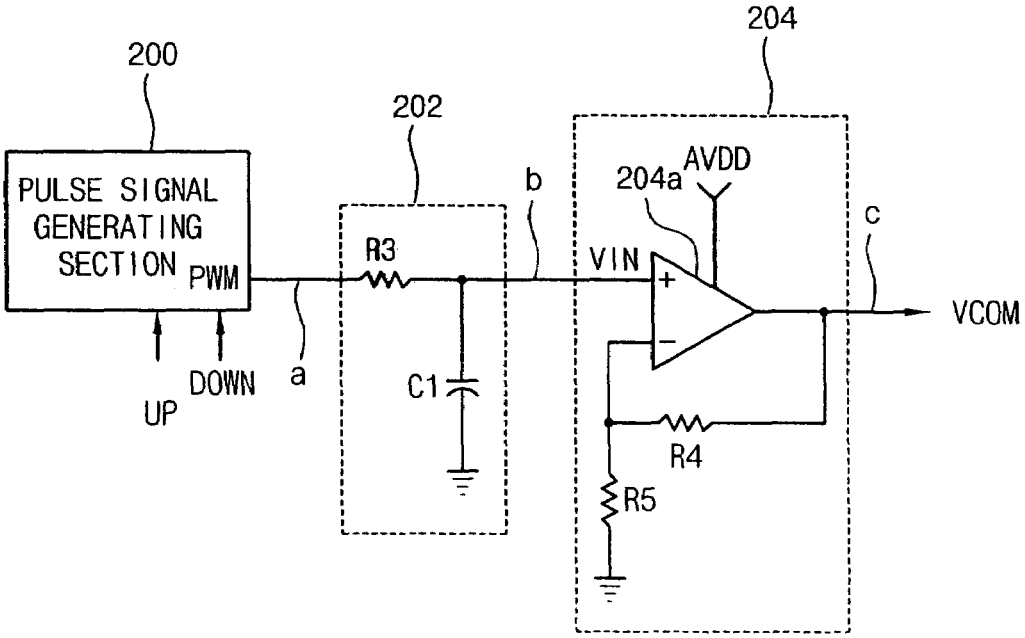
FIG. 8 is a block diagram illustrating a common voltage regulating circuit according to a first embodiment of the present invention.

FIG. 8 is a block diagram illustrating a common voltage regulating circuit according to the first embodiment of the present invention. As shown in FIG. 8, the common voltage regulating circuit includes a pulse signal generating section 200, a smoothing section 202 and an amplifying section 204. The pulse signal generating section 200 outputs a pulse width modulation signal (PWM) in response to an up/down signal UP/DOWN for adjusting a common voltage. The smoothing section 202 smoothes the pulse width modulation signal (PWM) of the pulse signal generating section 200 to a direct current level. The amplifying section 204 amplifies the smoothed signal by the smoothing section to a predetermined level and then outputs a common voltage signal.

The pulse signal generating section 200 includes two control pins and an output pin formed at outside so that the pulse signal generating section 200 can be adjusted by means of software, and receives the up/down signal UP/DOWN through the control pins and outputs the pulse width modulation signal (PWM) through the output pin.

The smoothing section 202 includes a third resistor R3 of receiving the pulse width modulation signal through one end, and a first capacitor C1 coupled between the other end of the third resistor R3 and a ground.

The amplifying section 204 includes a fourth resistor R4, a fifth resistor R5 and a non-inverting amplifier 204*a*. The fourth resistor R4 is coupled between an inverting terminal (−) and an output terminal, and the fifth resistor R5 is coupled between an inverting terminal (−) and a ground. The non-inverting amplifier 204*a* receives the smoothed signal by the smoothing section 202 through a non-inverting terminal (+), amplifies the smoothed signal to a predetermined level and then outputs the common voltage signal VCOM. The non-inverting amplifier 204*a* receives a supply voltage AVDD on an integrated board.

Figure 9:
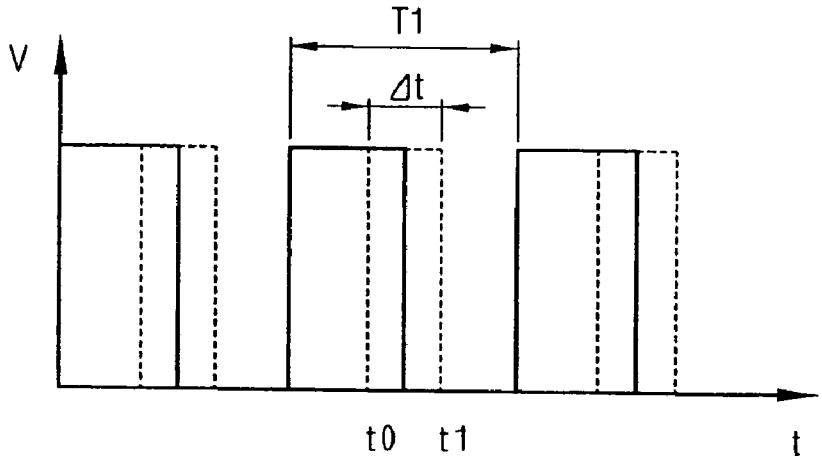
FIG. 9 is a waveform view showing a pulse width modulation signal according to the first embodiment of the present invention.
Figure 10:
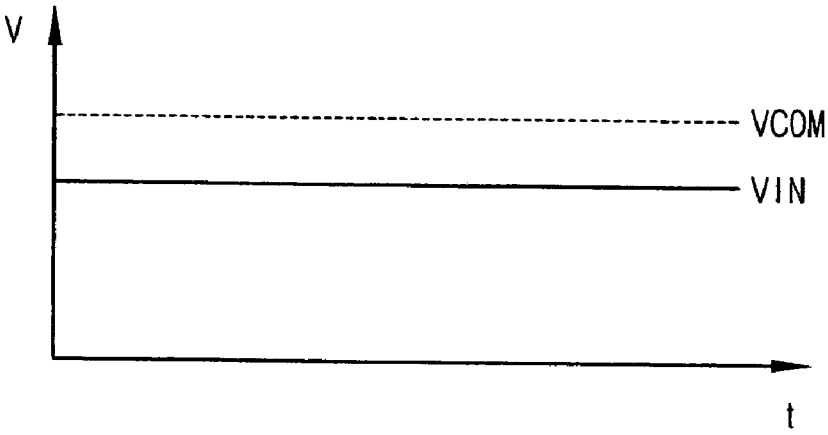
FIG. 10 is a waveform view showing a smoothed signal according to the first embodiment of the present invention.
Figure 11:
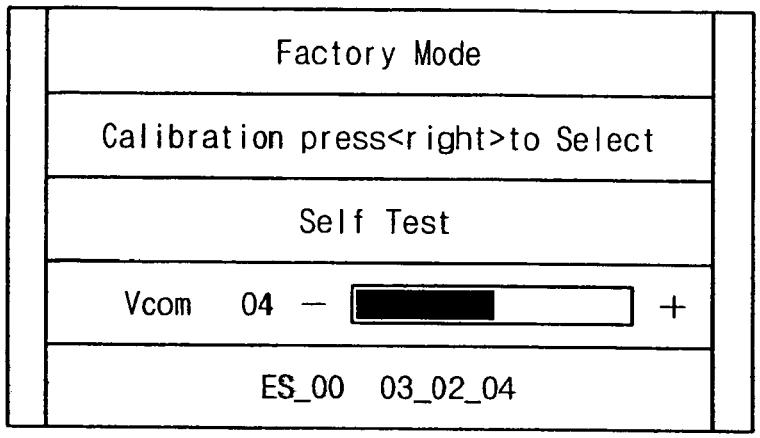
FIG. 11 is a view showing a common voltage adjustment menu according to the first embodiment of the present invention.

FIG. 9 is a waveform view showing a pulse width modulation signal according to the first embodiment of the present invention, FIG. 10 is a waveform view showing a smoothed signal according to the first embodiment of the present invention and FIG. 11 is a view showing a common voltage adjustment menu according to an embodiment of the present invention.

The operation of the first embodiment of the present invention constructed as above is described with reference to FIG. 9 to FIG. 11.

First, when there is an input of an up/down key for adjusting the common voltage, the up/down signal UP/DOWN is applied to the pulse signal generating section 200. The pulse signal generating section 200 generates the pulse width modulation signal (PWM) according to the up/down signal UP/DOWN.

As shown in FIG. 9, the pulse width modulation signal (PWM) has a period of T1 and is outputted through the output pin of the pulse signal generating section 200 with a variation width of ΔT, which is an interval from t0 to t1, in order to adjust the level of the common voltage.

The pulse width modulation (PWM) signal is designed in order to be initially located in an interval from t0 to t1 so that the common voltage signal VCOM can have an optimum value. Herein, the duty ratio of the pulse width modulation signal (PWM) is 50%. A ratio between the fourth resistor R4 and the fifth resistor R5 in the amplifying section 204 is determined so that the duty ratio 50% can be an optimum value of the common voltage signal VCOM.

Generally, since liquid crystal display devices have common voltage signals slightly different from each other according to deviation of the LCDs, it is necessary to adjust the common voltage signals. In the first embodiment of the present invention, the common voltage adjustment menu of FIG. 11 is displayed on a liquid crystal display screen, a display bar increases or decreases to a minus side or a plus side by the press of the up/down key. The default value of the display bar is located at the center.

Next, the pulse width modulation signal (PWM) is applied to the smoothing section 202 and then is smoothed. As shown in FIG. 10, as the duty ratio of the pulse width modulation signal (PWM) increases, a DC voltage level of a smoothed signal VIN increases. However, as the duty ratio of the pulse width modulation signal (PWM) decreases, the DC voltage level of the smoothed signal VIN decreases.

Next, the smoothed signal VIN smoothed by the smoothing section 202 is applied to the non-inverting terminal (+) of the amplifying section 204, and the amplifying section 204 amplifies sufficiently DC voltage level of the smoothed signal VIN to a level in which the smoothed signal VIN can be used as the common voltage signal VCOM.

According to the first embodiment of the present invention, the common voltage signal VCOM shown in equation 1 is generated from the non-inverting amplifying circuit of the amplifying section 204. The common voltage signal VCOM is determined by means of the ratio between the fourth resistor R4 and the fifth resistor R5 in the amplifying section 204 so that the duty ratio 50% of the pulse width modulation signal (PWM) can be an optimum value of the common voltage signal.

$$VOCM = VIN\left(1 + \left(\frac{R4}{R5}\right)\right) \quad \text{Equation 1}$$

According to the first embodiment of the present invention, the duty ratio 50% of the pulse width modulation signal (PWM) can be adjusted to be a value higher than the deviation range of the common voltage signal VCOM.

Figure 12:
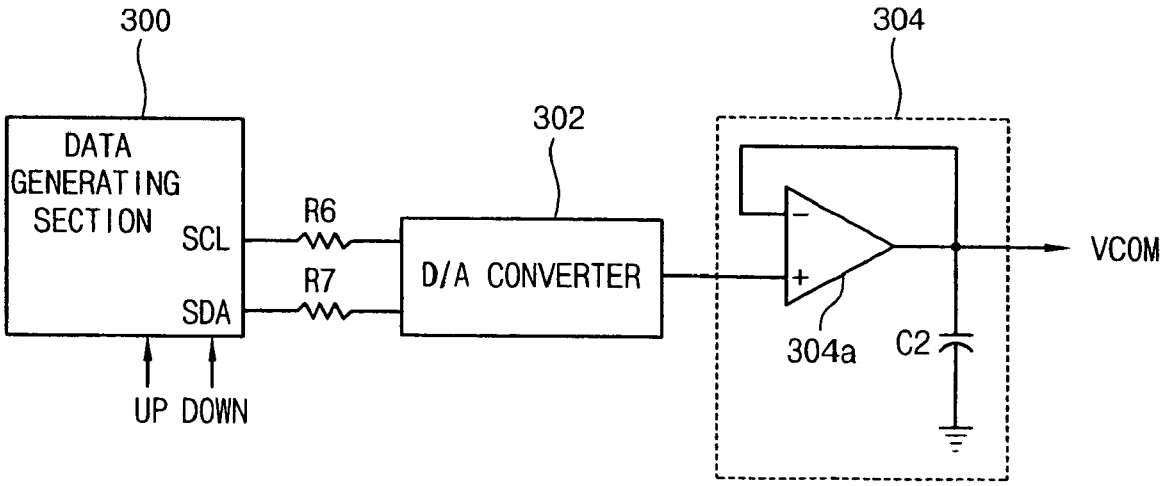
FIG. 12 is a block diagram illustrating a common voltage regulating circuit according to a second embodiment of the present invention.

FIG. 12 is a block diagram illustrating a common voltage regulating circuit according to a second embodiment of the present invention. As shown in FIG. 12, the common voltage regulating circuit includes a data generating section 300, a digital/analog converting section 302 and a buffer amplifying section 304. The data generating section 300 outputs a synchronizing signal SCL and a serial digital data signal SDA in response to up/down signal UP/DOWN for adjusting a common voltage. The digital/analog converting section 302 converts the serial digital data signal SDA into an analog signal in response to the synchronizing signal SCL of the data generating section 300 and then outputs the converted signal. The buffer amplifying section 304 buffers the analog signal converted by the digital/analog converting section 302 and then outputs a common voltage signal.

The data generating section 300 includes two control pins, which receive the up/down signal, and two output pins, which output the synchronizing signal SCL and the serial digital data signal SDA respectively, so that the data generating section 300 can be adjusted by software.

Between the data generating section 300 and the digital/analog converting section 302, a sixth resistor R6, which is a current limit resistor, is coupled to a line for transmitting the synchronizing signal, and a seventh resistor R7, which is a current limit resistor, is coupled to a line for transmitting the serial digital data signal SDA.

The buffer amplifying section 304 includes a buffer amplifier 304*a* and a second capacitor C2. The buffer amplifier 304*a* feedbacks the common voltage signal VCOM to an inverting terminal (−), receives the analog signal converted by the digital/analog converting section 302 through a non-inverting terminal (+) and buffers the converted analog signal. Further, the buffer amplifier 304*an* outputs the common voltage signal VCOM. The second capacitor C2 is coupled between an output terminal and a ground to remove an alternating current component of the common voltage signal.

The buffer amplifying section 304 may be constructed by means of a transistor and the output of the digital/analog converting section 302 may be used as the common voltage signal in some cases.

Figure 13:
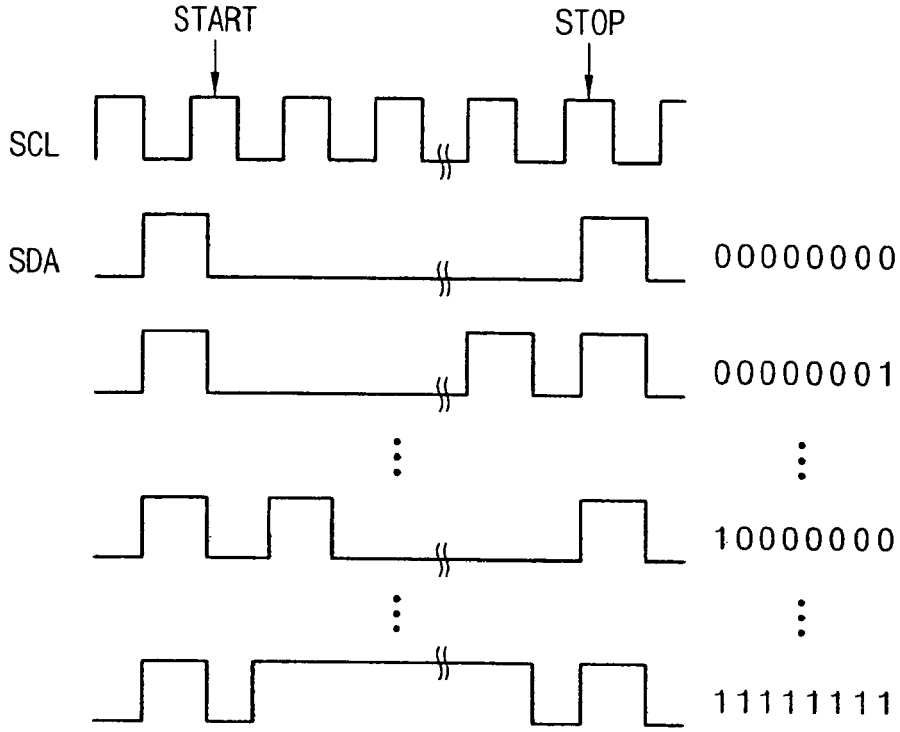
FIG. 13 is a waveform view showing a synchronizing signal and a serial digital data signal according to a second embodiment of the present invention.

FIG. 13 is a waveform view showing a synchronizing signal and a serial digital data signal according to a second embodiment of the present invention.

The operation of the second embodiment of the present invention constructed as above is described with reference to FIG. 13.

First, when there is up/down key input for adjusting the common voltage, up/down signal UP/DOWN is applied to the data generating section 300. As shown in FIG. 13, the data generating section 300 generates the synchronizing signal SCL and the serial digital data signal SDA according to the up/down signal UP/DOWN.

In the second embodiment of the present invention, since the digital/analog converting section 302 has a resolution of 8 bit, 8 bit serial digital data signal SDA generated in an interval between a start synchronizing signal START and a stop synchronizing signal STOP is applied to the digital/analog converting section 302. Herein, "the digital/analog converting section 302 has a resolution of 8 bit" means that levels of a common voltage signal VCOM, which can be changed (or modified), is up to $2^8$ (256 stage).

Assuming that the default value of the 8 bit serial digital data signal SDA is set at 10000000, when there is an input of the down key during that state, the 8 bit serial digital data signal SDA changes gradually in the direction of reduction and the value of the serial digital data signal SDA will finally become 00000000. However, when there is an input of the up key, the serial digital data signal SDA of 8 bit changes gradually in the direction of increase and the value of the serial digital data signal SDA will finally become 11111111.

Since the serial digital data signal SDA has different bit numbers according to the variable range of the common voltage signal VCOM, the bit numbers should be increased when a precise adjustment is necessary. Herein, the bit number is adjusted to be only a value higher than the deviation range of the common voltage signal.

Next, as shown in FIG. 13, when the serial digital data signal SDA generated during an interval between a start synchronizing signal START and a stop synchronizing signal STOP is inputted to the digital/analog converting section 302, the digital/analog converting section 302 converts the serial digital data signal SDA into an analog signal and then outputs the converted analog signal to the non-inverting terminal (+) the buffer amplifier 304*a*.

Then, the buffer amplifying section 304 amplifies the analog signal converted by the digital/analog converting section 302 by a unity gain and then outputs a common voltage signal. Herein, the alternating current component of the outputted common voltage signal is removed by the second capacitor C2.

Figure 14:
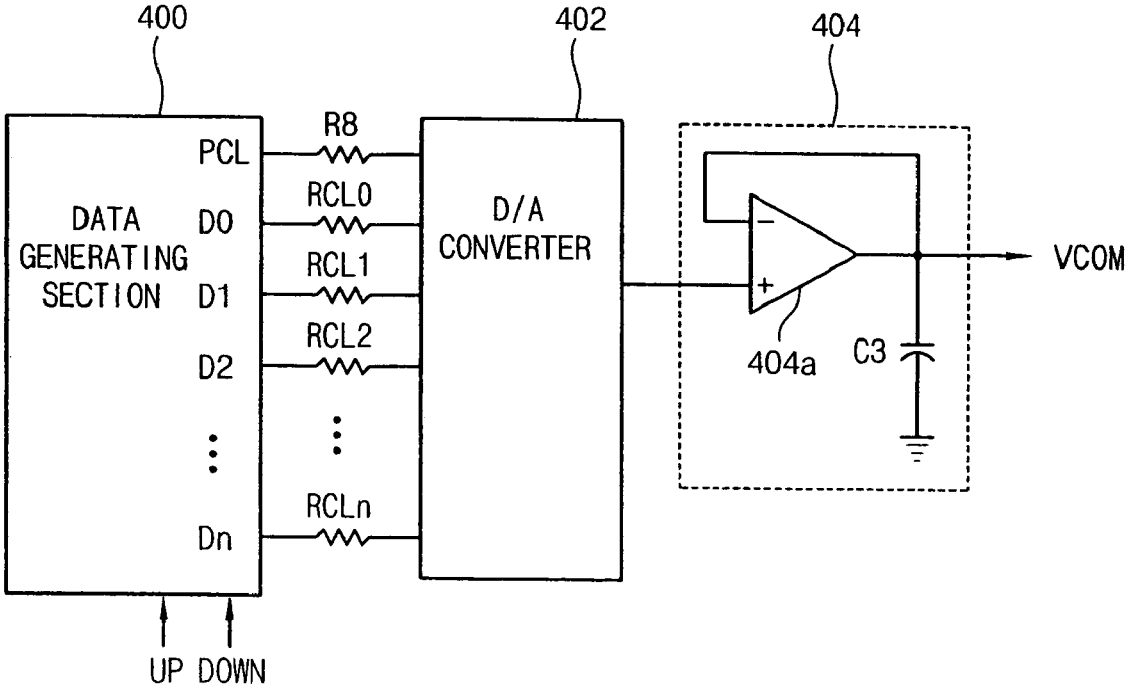
FIG. 14 is a block diagram illustrating a common voltage regulating circuit according to a third embodiment of the present invention.

FIG. 14 is a block diagram illustrating a common voltage regulating circuit according to a third embodiment of the present invention. As shown in FIG. 14, the common voltage regulating circuit includes a data generating section 400, a digital/analog converting section 402 and a buffer amplifying section 404. The data generating section 400 outputs a synchronizing signal PCL and a parallel digital data signals D0~Dn in response to up/down signal UP/DOWN for adjusting a common voltage. The digital/analog, converting section 402 converts the parallel digital data signals D0~$D_n$ into analog signals in response to the synchronizing signal PCL of the data generating section 400 and then outputs the converted signal. The buffer amplifying section 404 buffers the analog signal converted by the digital/analog converting section 402 and then outputs a common voltage signal VCOM.

The data generating section 400 includes two control pins, which receive the up/down signal, and n+2 number of output pins, which output the synchronizing signal PCL and the parallel digital data signals D0~$D_n$, so that the data generating section 400 can be adjusted by software.

Between the data generating section 400 and the digital/analog converting section 402, a eighth resistor R8, which is a current limit resistor, is coupled to a line for transmitting the synchronizing signal, and a plurality of resistors RCL0~$RCL_n$, which are current limit resistors, are coupled to lines for transmitting the parallel digital data signal. SDA, respectively.

There are a first line and a second line between the data generating section 400 and the digital/analog converting section 402. The first line is a line for transmitting the synchronizing signal and a eighth resistor R8, which is a current limit resistor, is coupled to the first line. Also, The second line is lines for transmitting the parallel digital data signals D0~$D_n$ and a plurality of resistors RCL0~$RCL_n$, which are current limit resistors, are coupled to the lines of the second line.

The buffer amplifying section 404 includes a buffer amplifier 404*a* and a third capacitor C3. The buffer amplifier 404*a* feedbacks the common voltage signal VCOM to an inverting terminal (−), receives the analog signal converted by the digital/analog converting section 402 through a non-inverting terminal (+) and buffers the converted analog signal. Further, the buffer amplifier 404*an* outputs the common voltage signal VCOM. The third capacitor C3 is coupled between an output terminal and a ground in order to remove an alternating current component of the common voltage signal VCOM.

In the third embodiment of the present invention, since the digital/analog converting section 402 has a resolution of 8 bit, the digital/analog converting section 402 receives the 8 bit parallel digital data signals D0~Dn and then converts the parallel digital data signals D0~Dn into the analog signal in response to the synchronizing signal PCL.

Herein, "the digital/analog converting section 402 has a resolution of 8 bit" means that levels of a common voltage signal VCOM, which can be changed, are up to $2^8$ (256 stage).

Since the bit number of the parallel digital data signals D0~Dn changes according to the variable range of the common voltage signal VCOM, when it is necessary to minutely adjust the variable range, the bit number should be increased. Herein, the bit number is adjusted to be only a value higher than deviation range of the common voltage signal.

The third embodiment of the present invention constructed as above is similar to the second embodiment, but there is a big difference in that the data generating section 400 outputs the parallel digital data signals D0~Dn instead of the serial digital data signal SDA and the digital/analog converting section 402 converts the parallel digital data signals D0~$D_n$ into the analog signals.

Figure 15:
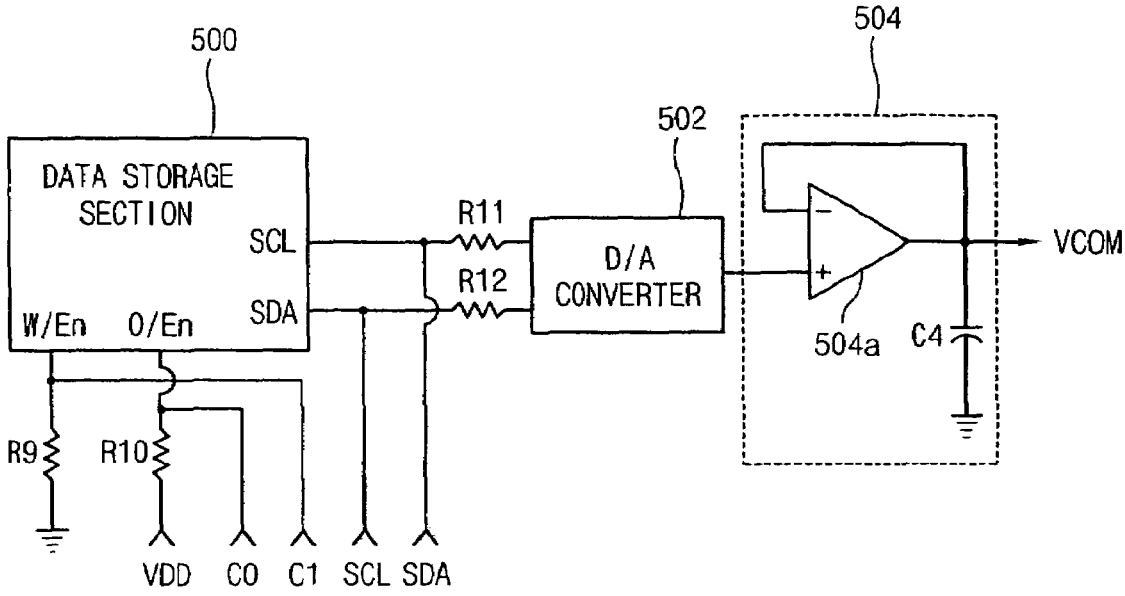
FIG. 15 is a block diagram illustrating a common voltage regulating circuit according to a fourth embodiment of the present invention.

FIG. 15 is a block diagram illustrating a common voltage regulating circuit according to a fourth embodiment of the present invention. As shown in FIG. 15, the common voltage regulating circuit includes a data storage section 500, a digital/analog converting section 502 and a buffer amplifying section 504. In order to adjust a common voltage, the data storage section 500 receives a synchronizing signal SCL and a serial digital data signal SDA according to a combination of a first selection signal C0 and a second selection signal C1, and stores the received synchronizing signal SCL and serial digital data signal SDA. Further, the data storage section 500 outputs the stored synchronizing signal SCL and serial digital data signal SDA according to a combination of a first selection signal C0 and a second selection signal C1. The digital/analog converting section 502 receives the serial digital data signal SDA from the data storage section 500 in response to the synchronizing signal SCL, and then converts the serial digital data signal SDA into an analog signal. The buffer amplifying section 504 buffers the analog signal converted by the digital/analog converting section 502 and then outputs a common voltage signal VCOM.

The data storage section 500 stores predetermined data and can modify the stored data. Further, the data storage section 500 includes two enable terminals W/En, O/En which enable the stored data to be outputted as serial digital data, and two input terminals for receiving the synchronizing signal SCL and the serial digital data signal SDA corresponding to each other.

The enable terminal W/En is used for receiving the first selection signal C0 and is coupled to a ground via a ninth resistor R9. The enable terminal O/En is used for receiving the second selection signal C1 and is coupled to a supply voltage VDD via a tenth resistor R10.

The synchronizing signal input terminal is coupled to the digital/analog converting section 502 via a eleventh resistor R11 which is a current limit resistor, and the serial digital data signal input terminal SDA is coupled to the digital/analog converting section 502 via a twelfth resistor R12 which is a current limit resistor.

The synchronizing signal SCL is inputted to the data storage section 500 and is simultaneously inputted to the digital/analog converting section 502.

The buffer amplifying section 504 includes a buffer amplifier 504*a* and a fourth capacitor C4. The buffer amplifier 504*a* feedbacks the common voltage signal VCOM to an inverting terminal (−), receives the analog signal converted by the digital/analog converting section 502 through a non-inverting terminal (+) and buffers the converted analog signal. Further, the buffer amplifier 504*a* outputs the common voltage signal VCOM. The fourth capacitor C4 is coupled between an output terminal and a ground to remove an alternating current component of the common voltage signal VCOM.

In the fourth embodiment of the present invention constructed as above, the four input signals, that is, the first selection signal C0, the second selection signal C1, the synchronizing signal SCL and the serial digital data signal SDA, are applied to the data storage section 500. Herein, the states of the four input, signals are shown in table 1.

TABLE 1

| | Test | Write | FIX |
|---|---|---|---|
| C0 | L | L | NC |
| C1 | L | H | NC |
| SCL | CLOCK | CLOCK | NC |
| SDA | DATA | DATA | NC |

In the above table, L represents a "low" state in a logic level, H represents a "High" state in a logic level and NC represents connection state respectively.

The operation of the fourth embodiment of the present invention is described with reference to table 1. First, in the test mode of testing an optimum value of the common voltage, the state of the first selection signal C0 is L and the state of the second selection signal C1 is L. Then, the data storage section 500 is in a state in which both writing and outputting can't be performed.

Accordingly, in the test mode, the synchronizing signal SCL and the serial digital data signal SDA are inputted not to the data storage section 500 but to the digital/analog converting section 502. Then, the synchronizing signal SCL and the serial digital data signal SDA are converted into the analog signals.

Also, when an optimum serial digital data signal SDA is determined in an outside, it is necessary for the data signal to be stored in the data storage section 500. In order to store the data signal, a write mode of table 1 is used. In the write mode, the state of the first selection signal C0 is L and the state of the second selection signal C1 is H. Herein, the data storage section 500 is in a state in which writing can be performed but outputting cannot be performed.

Next, when the four inputs are opened after a liquid crystal display device has been manufactured in a state in which data input has been completed, as shown in table 1, the fourth embodiment of the present invention becomes a FIX mode. In this FIX mode, the input terminals for inputting the first selection signal C0, the second selection signal C1, the synchronizing signal SCL and the serial digital data signal SDA are all "NC" state. In this case, the data storage section 500 is in a state in which writing is inhibited by the ninth resistor R9 and the tenth resistor R10, but outputting can be performed.

Accordingly, in the FIX mode, the serial digital data signal SDA stored in the data storage section 500 is outputted as an optimum common voltage signal VCOM through the analog/digital conversion process and the amplification process.

In the fourth embodiment of the present invention, since description of an operation of the digital/analog converting section 502 and the buffer amplifying section 504 is the same as that of the second embodiment, detailed description is omitted.

Figure 16:
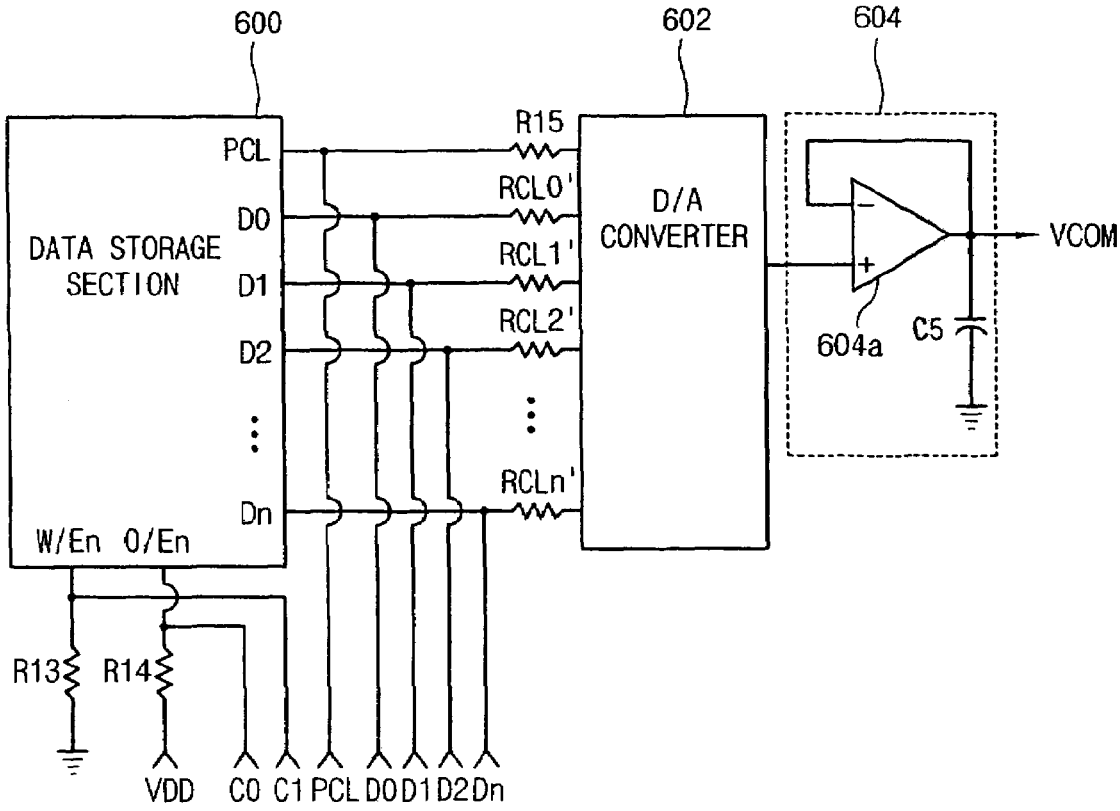
FIG. 16 is a block diagram illustrating a common voltage regulating circuit according to a fifth embodiment of the present invention.

FIG. 16 is a block diagram illustrating a common voltage regulating circuit according to a fifth embodiment of the present invention. As shown in FIG. 16, the common voltage regulating circuit includes a data storage section 600, a digital/analog converting section 602 and a buffer amplifying section 604. In order to adjust a common voltage, the data storage section 600 receives a synchronizing signal SCL and a parallel digital data signals D0~Dn according to a combination of a first selection signal C0 and a second selection signal C1, and stores the received synchronizing signal SCL and serial digital data signal SDA. Further, the data storage section 500 outputs the stored synchronizing signal SCL and parallel digital data signals D0~Dn according to a combination of a first selection signal C0 and a second selection signal C1. The digital/analog converting section 602 receives the parallel digital data signals D0~Dn from the data storage section 600 in response to the synchronizing signal SCL, and then converts the parallel digital data signals D0~$D_n$ into analog signals. The buffer amplifying section 604 buffers the analog signal converted by the digital/analog converting section 602 and then outputs a common voltage signal VCOM.

The data storage section 600 stores predetermined data and can modify the stored data. Further, the data storage section 600 includes two enable terminals W/En, O/En which enable the stored data to be outputted in serial digital data, and includes two input terminals for receiving the synchronizing signal SCL and the parallel digital data signals D0~$D_n$ corresponding to each other.

The enable terminal W/En is used for receiving the first selection signal C0 and is coupled to a ground via a thirteenth resistor R13. The enable terminal O/En is used for receiving the second selection signal C1 and is coupled to a supply voltage VDD via a fourteenth resistor R14.

The synchronizing signal input terminal is coupled to the digital/analog converting section 602 via a fifteenth resistor R15 which is a current limit resistor, and the parallel digital data signals D0~$D_n$ are respectively coupled to the digital/analog converting section 602 via a plurality of resistors RCL0'~RCLn' which are current limit resistors.

The synchronizing signal SCL is inputted to the data storage section 600 and is simultaneously inputted to the digital/analog converting section 602.

The buffer amplifying section 604 includes a buffer amplifier 604*a* and a fifth capacitor C5. The buffer amplifier 604*a* feedbacks the common voltage signal VCOM to an inverting terminal (−), receives the analog signal converted by the digital/analog converting section 602 through a non-inverting terminal (+) and buffers the converted analog signal. Further, the buffer amplifier 604*a* outputs the common voltage signal VCOM. The fifth capacitor C5 is coupled between an output terminal and a ground to remove an alternating current component of the common voltage signal VCOM.

In the fifth embodiment of the present invention constructed as above, the first selection signal C0, the second selection signal C1, the synchronizing signal PCL and the parallel digital data signals D0~$D_n$ are applied to the data storage section 600. Herein, the states of the four input signals are shown in table 2.

TABLE 2

| | Test | Write | FIX |
|---|---|---|---|
| C0 | L | L | NC |
| C1 | L | H | NC |
| PCL | CLOCK | CLOCK | NC |
| D0 | DATA | DATA | NC |
| D1 | DATA | DATA | NC |
| D2 | DATA | DATA | NC |
| . . . | . . . | . . . | . . . |
| $D_n$ | DATA | DATA | NC |

In the above table, L represents a "low" state in a logic level, H represents a "High" state in a logic level and NC represents connection state respectively.

The operation of the fifth embodiment of the present invention is described with reference to table 2. First, in the test mode of testing an optimum value of the common voltage, the state of the first selection signal C0 is L and the state of the second selection signal C1 is L. Herein, the data storage section 500 is in a state in which both writing and outputting can't be performed.

Accordingly, in the test mode, the synchronizing signal SCL and the parallel digital data signals D0~$D_n$ are inputted not to the data storage section 600 but to the digital/analog converting section 602. Then, the synchronizing signal SCL and the parallel digital data signals D0~$D_n$ are converted into the analog signals.

Also, when an optimum parallel digital data signals D0~$D_n$ is determined from an outside, it is necessary for the data signal to be stored in the data storage section 600. In order to store the data signal, a write mode of table 2 is used. In the write mode, the state of the first selection signal C0 is L and the state of the second selection signal C1 is H. Herein, the data storage section 600 is in a state in which writing can be performed but outputting can't be performed.

Next, when the four inputs are opened after a liquid crystal display device has been manufactured in a state in which the write mode has been completed, as shown in table 2, the fifth embodiment of the present invention becomes a FIX mode. In this FIX mode, the input terminals for inputting the first selection signal C0, the second selection signal C1, the synchronizing signal SCL and the parallel digital data signals D0~$D_n$ are all "NC" state. In this case, the data storage section 600 is in a state in which writing is inhibited by the thirteenth resistor R13 and the fourteenth resistor R14, but outputting can be performed.

In the fifth embodiment of the present invention, since description of an operation of the digital/analog converting section 602 and the buffer amplifying section 604 is the same as that of the second embodiment, the detailed description is omitted.

Figure 17:
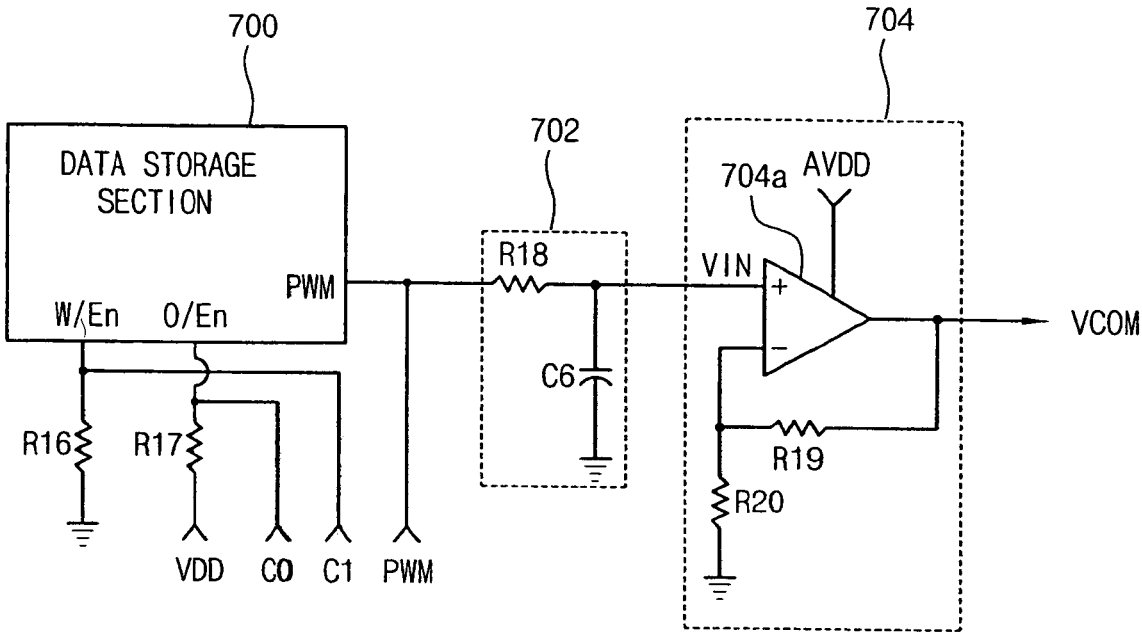
FIG. 17 is a block diagram illustrating a common voltage regulating circuit according to a sixth embodiment of the present invention.

FIG. 17 is a block diagram illustrating a common voltage regulating circuit according to a sixth embodiment of the present invention. As shown in FIG. 17, the common voltage regulating circuit includes a data storage section 700, a smoothing section 702 and a buffer amplifying section 704.

The data storage section 700 receives a first selection signal C0, a second selection signal C1 and a pulse width modulation signal (PWM), and stores or outputs the pulse width modulation signal (PWM) according to a combination of the first selection signal C0 and the second selection signal C1. The smoothing section 702 smoothes the pulse width modulation signal (PWM) inputted from an outside to a direct current level in test mode and smoothes the pulse width modulation signal (PWM) inputted from the data storage section 700 to the direct current level in write mode. The buffer amplifying section 704 amplifies the smoothed signal to a predetermined level and then outputs a common voltage signal VCOM.

The data storage section 700 stores predetermined data and can modify the stored data. Further, the data storage section 700 includes two enable terminals W/En, O/En which enable the stored data to be outputted in serial digital data, and includes input/output terminals for receiving or outputting the pulse width modulation signal (PWM).

The writing enable terminal W/En is used for receiving the first selection signal C0 and is coupled to a ground via, a sixteenth resistor R16. The enable terminal O/En is used for receiving the second selection signal C1 and is coupled to a supply voltage VDD via a seventeenth resistor R17.

The smoothing section 702 includes an eighteenth resistor R18 and a sixth capacitor C6. The eighteenth resistor R18 receives the pulse width modulation signal (PWM) from an outside or the data storage section 700 through one end. The sixth capacitor C6 is coupled between the other end of the eighteenth resistor R18 and a ground.

The buffer amplifying section 704 includes a nineteenth resistor R19, a twentieth resistor R20 and a non-inverting amplifier 704*a*. The nineteenth resistor R19 is coupled between an inverting terminal (−) and an output terminal and the twentieth resistor R20 is coupled between the inverting terminal (−) and a ground. The non-inverting amplifier 704*a* receives the smoothed signal by the smoothing section 702 through a non-inverting terminal (+) and then amplifies the smoothed signal in order to output the common voltage signal VCOM.

In the sixth embodiment of the present invention constructed as above, the first selection signal C0, the second selection signal C1 and the pulse width modulation signal (PWM) are applied to the data storage section 700. Herein, the states of the three input signals are shown in table 3.

TABLE 1

| | Test | Write | FIX |
|---|---|---|---|
| C0 | L | L | NC |
| C1 | L | H | NC |
| PWM | PULSE | PULSE | NC |

In the above table, L represents a "low" state in a logic level, H represents a "High" state in a logic level and NC represents connection state, respectively.

The operation of the sixth embodiment of the present invention is described with reference to table 3. First, in the test mode of testing an optimum value of the common voltage, the state of the first selection signal C0 is L and the state of the second selection signal C1 is L. Herein, the data storage section 700 is in a state in which both writing and outputting can't be performed.

Accordingly, in the test mode, the pulse width modulation signal (PWM) is inputted not to the data storage section 700 but to the smoothing section 702. Then, the pulse width modulation signal (PWM) is smoothed.

Also, when a duty ratio of an optimum pulse width modulation signal (PWM) is determined from an outside, it is necessary for the data signal to be stored in the data storage section 700. In order to store the data signal, a write mode of table 3 is used. In the write mode, the state of the first selection signal C0 is L and the state of the second selection signal C1 is H. Herein, the data storage section 700 is in a state in which writing can be performed but outputting can't be performed.

Next, when the three inputs are opened after a liquid crystal display device has been manufactured in a state in which the write mode has been completed, as shown in table 3, the sixth embodiment of the present invention becomes a FIX mode. In this FIX mode, the input terminals for inputting the first selection signal C0, the second selection signal C1 and the pulse width modulation signal (PWM) are all "NC" state. In this case, the data storage section 700 is in a state in which writing is inhibited by the sixteenth resistor R16 and the seventeenth resistor R17, but outputting is possible.

Accordingly, in the FIX mode, the pulse width modulation signal (PWM) stored in the data storage section 700 is outputted as an optimum common voltage signal VCOM through the smoothing process and the amplification process.

Figure 18:
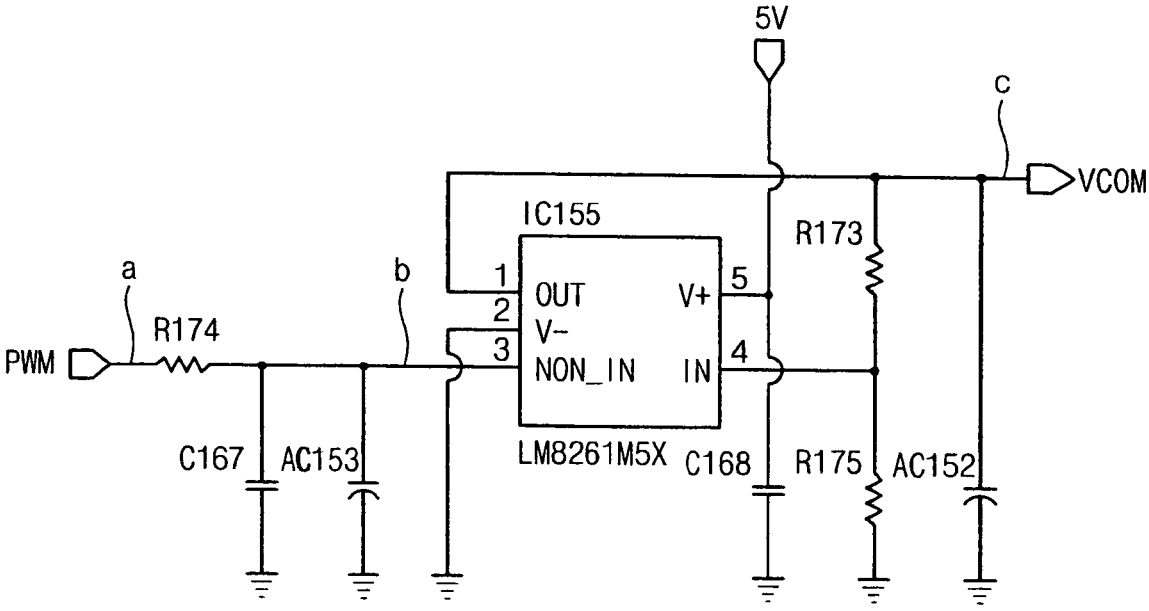
FIG. 18 is a block diagram illustrating a common voltage regulating circuit employing the first embodiment of the present invention.
Figures 19, 20:
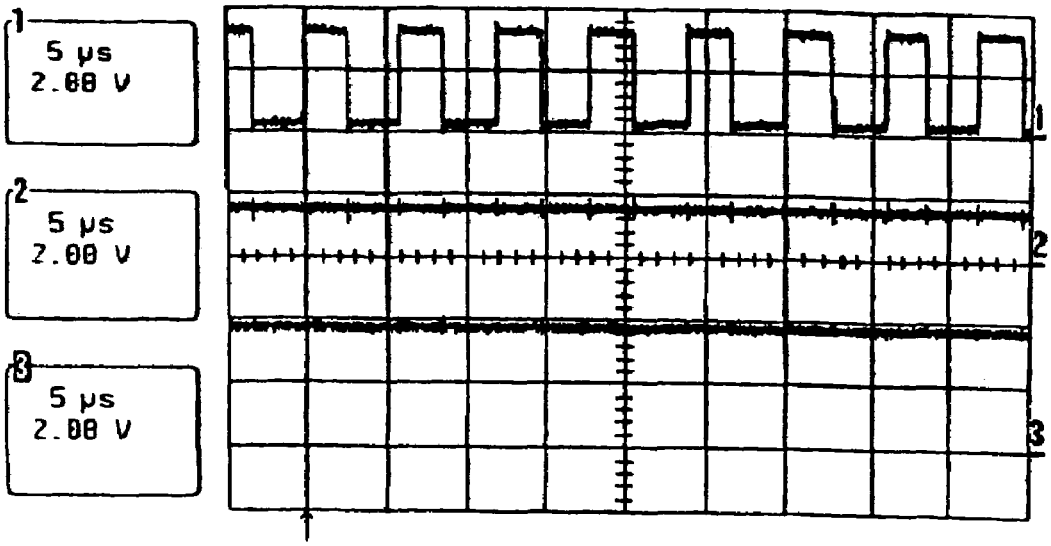
FIG. 19 is a table of data measured at each node in FIG. 18.
FIG. 20 to FIG. 27 are views showing waveforms measured at each node in FIG. 18.

FIG. 18 is a block diagram illustrating a common voltage regulating circuit employing the first embodiment of the present invention. FIG. 19 is a table of data measured at each node in FIG. 18, and FIG. 20 to FIG. 27 are views showing waveforms measured at each node in FIG. 18. Herein, a value measured at node (a) represents a duty ratio of the pulse width modulation signal, a value measured at node (b) represents a smoothed DC value and a value measured at node (c) represents a common voltage signal value, respectively.

FIG. 20 is a waveform view showing waveforms measured at each node a, b, c when a common voltage adjustment menu value is 00. In this case, a frequency is 167.127 kHz, the duty ratio is 45.18%, the smoothed DC value is 1.508V and the common voltage signal value is 3.676V.

Figure 21:
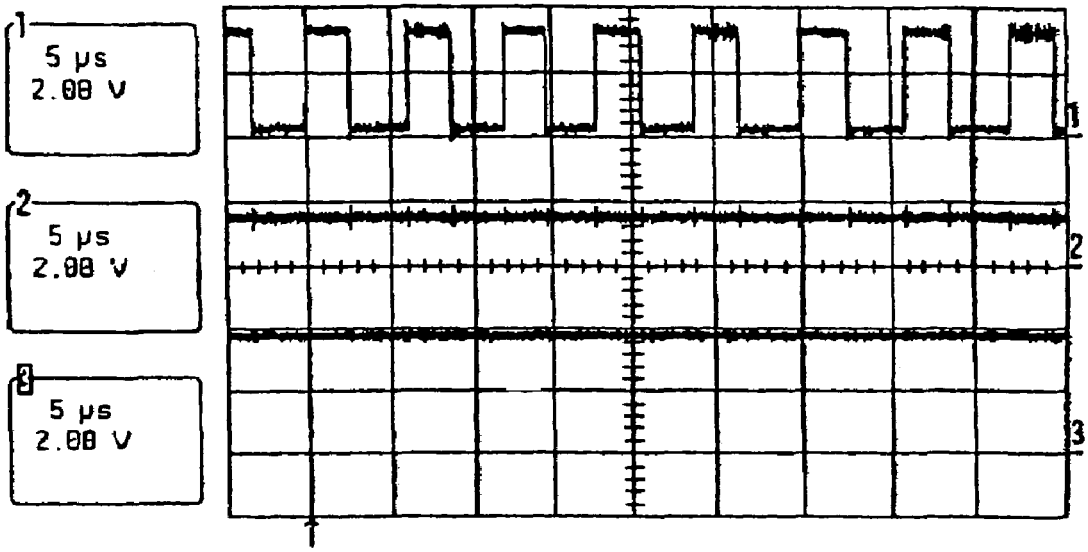

FIG. 21 is a waveform view showing waveforms measured at each node a, b, c when a common voltage adjustment menu value is 01. In this case, a frequency is 167.087 kHz, the duty ratio is 45.55%, the smoothed DC value is 1.518V and the common voltage signal value is 3.704V.

Figure 22:
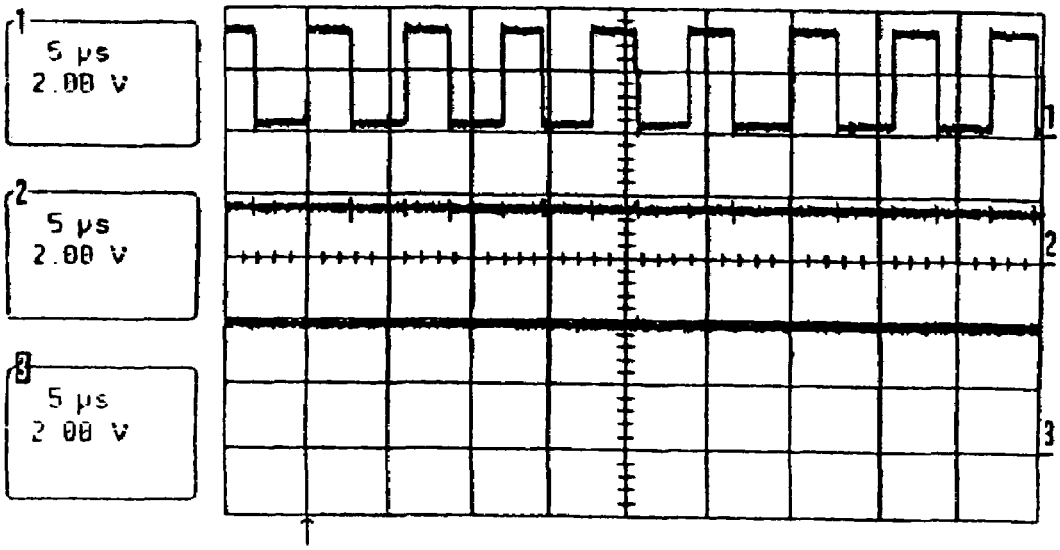

FIG. 22 is a waveform view showing waveforms measured at each node a, b, c when a common voltage adjustment menu value is 02. In this case, a frequency is 167.115 kHz, the duty ratio is 45.30%, the smoothed DC value is 1.548V and the common voltage signal value is 3.766V.

Figure 23:
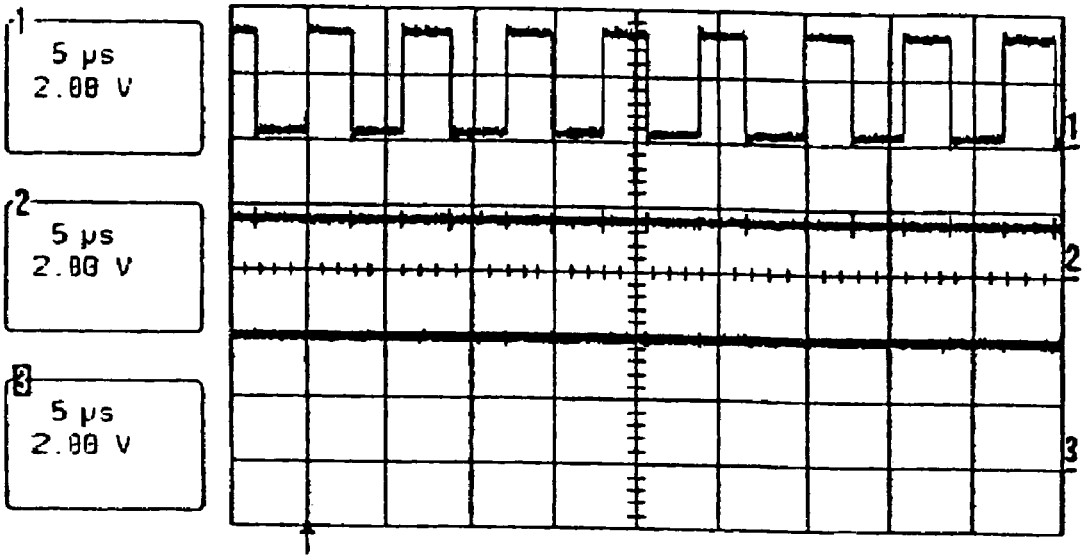

FIG. 23 is a waveform view showing waveforms measured at each node a, b, c when a common voltage adjustment menu value is 03. In this case, a frequency is 167.051 kHz, the duty ratio is 46.72%, the smoothed. DC value is 1.556V and the common voltage signal value is 3.794V.

Figure 24:
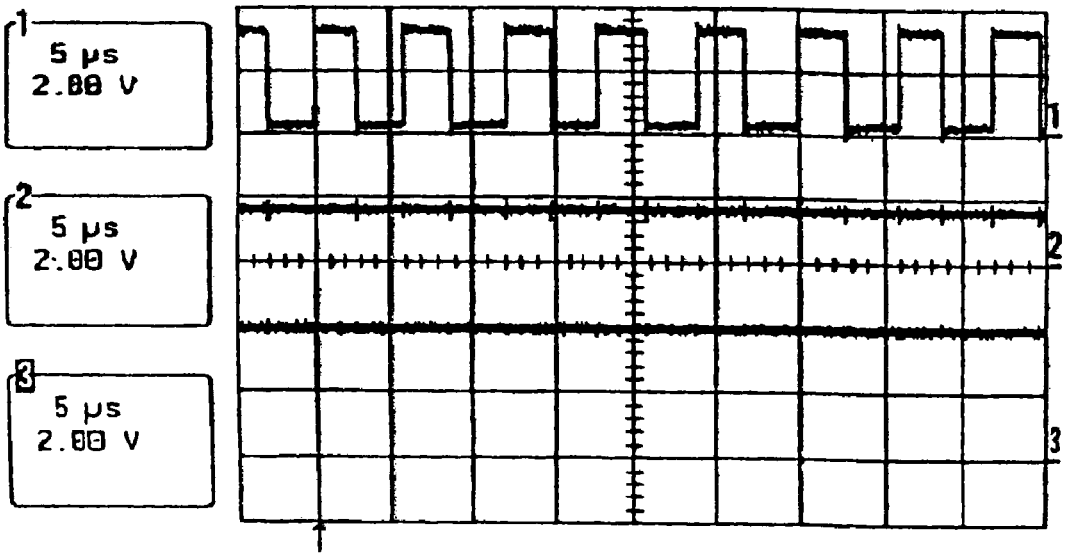

FIG. 24 is a waveform view showing waveforms measured at each node a, b, c when a common voltage adjustment menu value is 04. In this case, a frequency is 167.176 kHz, the duty ratio is 47.07%, the smoothed DC value is 1.571V and the common voltage signal value is 3.831V.

Figure 25:
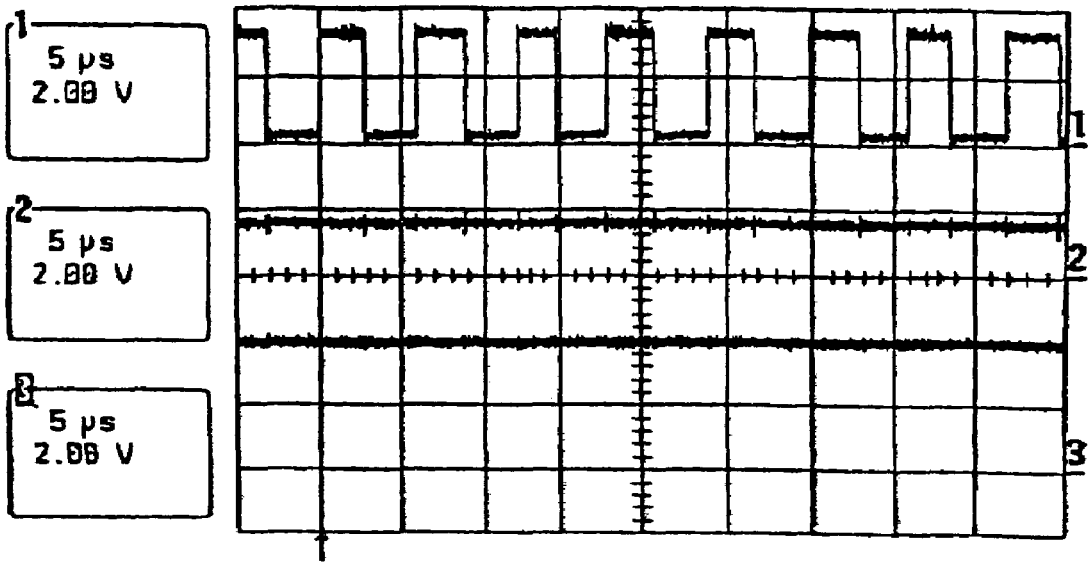

FIG. 25 is a waveform view showing waveforms measured at each node a, b, c when a common voltage adjustment menu value is 05. In this case, a frequency is 167.176 kHz, the duty ratio is 47.13%, the smoothed DC value is 1.566V and the common voltage signal value is 3.834V.

Figure 26:
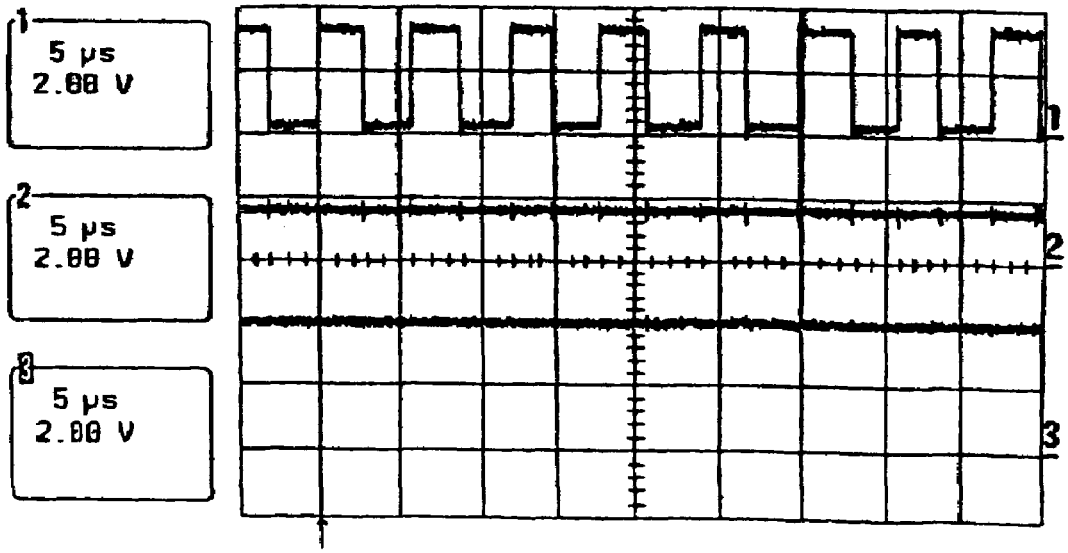

FIG. 26 is a waveform view showing waveforms measured at each node a, b, c when a common voltage adjustment menu value is 06. In this case, a frequency is 167.176 kHz, the duty ratio is 47.51%, the smoothed DC value is 1.580V and the common voltage signal value is 3.861V.

Figure 27:
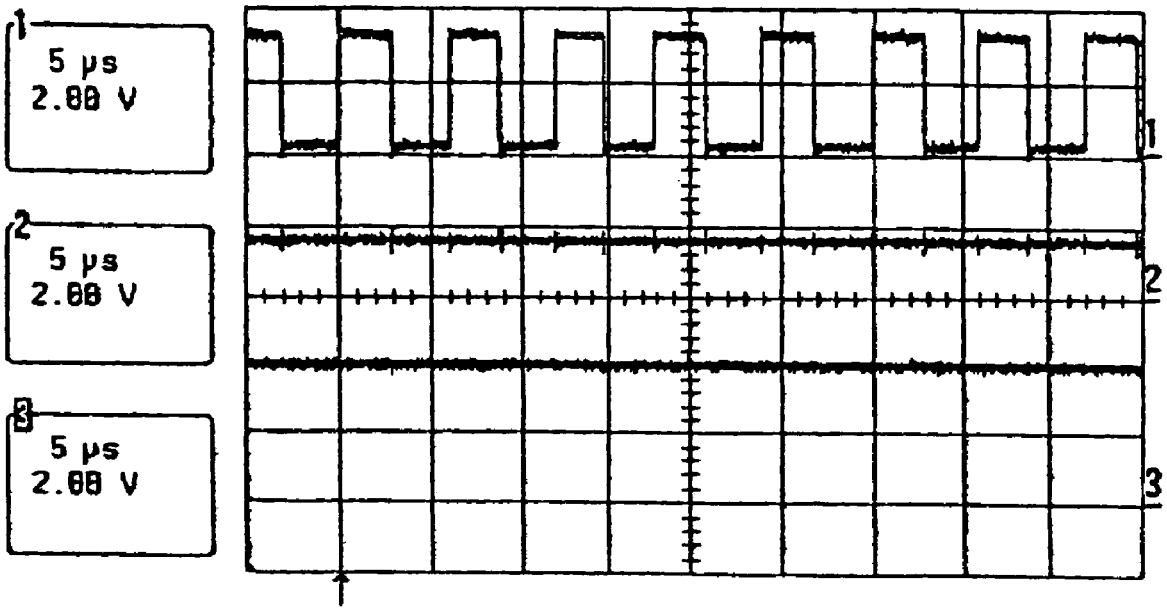

FIG. 27 is a waveform view showing waveforms measured at each node a, b, c when a common voltage adjustment menu value is 07. In this case, a frequency is 167.156 kHz, the duty ratio is 47.94%, the smoothed DC value is 1.590V and the common voltage signal value is 3.895V.

As described above, according to the present invention, since a common voltage can be adjusted by software by means of a surplus pulse width modulation signal generated, in an integrated board without installing a separate hardware the common voltage can be easily adjusted even after a liquid crystal display device has been assembled.

Further, according to the present invention, in order to minutely adjust a common voltage, since a common voltage can be adjusted by means of a surplus pulse width modulation signal generated in an integrated board, instead of a variable resistor, not only the manufacturing cost but also the possibility of breakage can be reduced.

Further, according to the present invention, a groove for adjustment of a resistance of a variable resistor, which has been formed in a bezel of a front surface of a liquid crystal display panel, and a variable resistor, which has been installed on a gate-printed circuit board, can be removed. Therefore, when products, which have neither a gate-printed circuit board nor a source-printed circuit board, are designed, the degree of freedom of the design can be improved.

The preferred embodiment of the present invention has been described for illustrative purposes, and those skilled in the art will appreciate that various modifications, additions and substitutions are possible, without departing from the scope and spirit of the invention as disclosed in the accompanying claims.

We claim:

1. A common voltage regulating circuit of a liquid crystal display device, comprising:

a data generating unit for outputting a synchronizing signal and a serial digital data signal in response to an up/down signal for adjusting a common voltage;

a digital/analog converting unit for converting the serial digital data signal into an analog signal in response to the synchronizing signal of the data generating unit wherein a plurality of current limiting resistors are coupled between the data generating unit and the digital/analog converting unit; and a buffer amplifying unit for buffering the analog signal converted by the digital/analog converting unit and then outputting a common voltage signal.

2. The common voltage regulating circuit of a liquid crystal display device according to claim 1, wherein the buffer amplifying unit includes a buffer amplifier and a capacitor, wherein the buffer amplifier feedbacks the common voltage signal to an inverting terminal, receives the analog signal converted by the digital/analog converting unit through a non-inverting terminal, buffers the analog signal and then outputs the common voltage signal, and wherein the capacitor is coupled between an output terminal and a ground in order to remove an alternating current component.

3. The common voltage regulating circuit of a liquid crystal display device according to claim 1, wherein the change in the bit number value of the serial digital data signal corresponds to the change in the common voltage signal.

4. A common voltage regulating circuit of a liquid crystal display device, comprising:

a data generating unit for outputting a synchronizing signal and a parallel digital data signal in response to an up/down signal for adjusting a common voltage;

a digital/analog converting unit for converting the parallel digital data signal into an analog signal in response to the synchronizing signal of the data generating unit wherein a plurality of resistors are coupled between the data generating unit and the digital/analog converting unit; and a buffer amplifying unit for buffering the analog signal converted by the digital/analog converting unit and then outputting a common voltage signal.

5. The common voltage regulating circuit of a liquid crystal display device according to claim 4, wherein the buffer amplifying unit includes a buffer amplifier and a capacitor, wherein the buffer amplifier feedbacks the common voltage signal to an inverting terminal, receives the analog signal converted by the digital/analog converting unit through a non-inverting terminal, buffers the analog signal and then outputs the common voltage signal, and wherein the capacitor is coupled between an output terminal and a ground in order to remove an alternating current component.

6. The common voltage regulating circuit of a liquid crystal display device according to claim 4, wherein change in the bit number value of the serial digital data signal corresponds to the change in the common voltage signal.

7. A common voltage regulating circuit of a liquid crystal display device, comprising:

a data storage unit for receiving a first selection signal, a second selection signal, a synchronizing signal and a serial digital data signal in order to adjust a common voltage, and storing and outputting the synchronizing signal and the serial digital data signal according to a combination of the first selection signal and the second selection signal;

a digital/analog converting unit for converting the serial digital data signal outputted from the data storage unit into an analog signal in response to the synchronizing signal provided from the data storage unit in an output mode of the data storage unit and converting a serial digital data signal inputted from an outside into an analog signal in response to a synchronizing signal inputted from an outside in inhibition of both write and output modes of the data storage unit; and a buffer amplifying unit for buffering the analog signal converted by the digital/analog converting unit and then outputting a common voltage signal.

8. The common voltage regulating circuit of a liquid crystal display device according to claim 7, wherein, when the first selection signal and the second selection signal are disabled, the data storage unit is in a state in which both writing and reading are inhibited.

9. The common voltage regulating circuit of a liquid crystal display device according to claim 7, wherein, when the first selection signal is disabled and the second selection signal is enabled, the data storage unit is in a state in which only writing can be performed.

10. The common voltage regulating circuit of a liquid crystal display device according to claim 7, wherein, when inputs of the first selection signal, the second selection signal, the synchronizing signal and the serial digital data signal are opened, the data storage unit is in a state in which only outputting can be performed.

11. The common voltage regulating circuit of a liquid crystal display device according to claim 7, wherein the buffer amplifying unit includes a buffer amplifier and a capacitor, wherein the buffer amplifier feedbacks the common voltage signal to an inverting terminal, receives the analog signal converted by the digital/analog converting unit through a non-inverting terminal, buffers the analog signal and then outputs the common voltage signal, and wherein the capacitor is coupled between an output terminal and a ground in order to remove an alternating current component.

12. The common voltage regulating circuit of a liquid crystal display device according to claim 7, wherein the change in the bit number value of the serial digital data signal corresponds to the change in the common voltage signal.

13. A common voltage regulating circuit of a liquid crystal display device, comprising:

a data storage unit for receiving a first selection signal, a second selection signal, a synchronizing signal and a parallel digital data signal in order to adjust a common voltage, and storing and outputting the synchronizing signal and the parallel digital data signal according to a combination of the first selection signal and the second selection signal;

a digital/analog converting unit for converting a parallel digital data signal inputted from art outside into an analog signal in response to a synchronizing signal inputted from an outside in inhibition of both write and output modes of the data storage unit and converting the parallel digital data signal outputted from the data storage unit into an analog signal in response to the synchronizing signal provided from the data storage unit in outputting mode of the data storage unit;

a buffer amplifying unit for buffering the analog signal converted by the digital/analog converting unit and then outputting a common voltage signal.

14. The common voltage regulating circuit of a liquid crystal display device according to claim 13, wherein, when both the first selection signal and the second selection signal are "L" state in a logic level, the data storage unit is in a state in which both writing and reading are inhibited.

15. The common voltage regulating circuit of a liquid crystal display device according to claim 13, wherein, when the first selection signal is "L" state in a logic level and the second selection signal is "H" state in a logic level, the data storage unit is in a state in which only writing can be performed.

16. The common voltage regulating circuit of a liquid crystal display device according to claim 13, wherein, when inputs of the first selection signal, the second selection signal, the synchronizing signal and the serial digital data signal are opened, the data storage unit is in a state in which only outputting can be performed.

17. The common voltage regulating circuit of a liquid crystal display device according to claim 13, wherein, when both the first selection signal and the second selection signal are "low" state in a logic level, the digital/analog converting unit receives a synchronizing signal and a parallel data signal inputted from an outside, and then generates an analog signal.

18. The common voltage regulating circuit of a liquid crystal display device according to claim 13, wherein the buffer amplifying unit includes a buffer amplifier and a capacitor, wherein the buffer amplifier feedbacks the common voltage signal to an inverting terminal, receives the analog signal converted by the digital/analog converting through a non-inverting terminal, buffers the analog signal and then outputs the common voltage signal, and wherein the capacitor is coupled between an output terminal and a ground in order to remove an alternating current component.

19. The common voltage regulating circuit of a liquid crystal display device according to claim 13, wherein change in the bit number value of the serial digital data signal corresponds to the change in the common voltage signal.

* * * * *